US007353583B1

(12) United States Patent
Clarke

(10) Patent No.: US 7,353,583 B1
(45) Date of Patent: Apr. 8, 2008

(54) METHOD OF FORMING AN UMBRELLA CANOPY

(76) Inventor: Dougan H. Clarke, 2900 NW. 35th St., Miami Beach, FL (US) 33142

( * ) Notice: Subject to any disclaimer, the term of this patent is extended or adjusted under 35 U.S.C. 154(b) by 525 days.

(21) Appl. No.: 11/027,697

(22) Filed: Dec. 30, 2004

Related U.S. Application Data

(60) Provisional application No. 60/533,196, filed on Dec. 30, 2003.

(51) Int. Cl.
*A45B 25/18* (2006.01)
*A45B 25/00* (2006.01)

(52) U.S. Cl. ..... 29/428; 29/25; 29/412; 135/15.1; 135/33.2

(58) Field of Classification Search ..... 29/25, 29/412, 415, 416, 428; 135/15.1, 33.2
See application file for complete search history.

(56) References Cited

U.S. PATENT DOCUMENTS

| | | | | |
|---|---|---|---|---|
| 2,745,421 | A | 5/1956 | Russell | |
| 4,368,749 | A | 1/1983 | Lindler et al. | |
| 4,832,304 | A | 5/1989 | Morgulis | |
| 4,993,445 | A | 2/1991 | Dubinsky | |
| 5,020,557 | A | 6/1991 | Apple | |
| 5,193,566 | A | 3/1993 | Chen | |
| 5,218,981 | A * | 6/1993 | Lai | 135/33.2 |
| 5,355,903 | A | 10/1994 | Haddad et al. | |
| 5,488,966 | A * | 2/1996 | Baldwin et al. | 135/33.2 |
| 5,640,984 | A | 6/1997 | Dubunsky | |
| 5,836,328 | A | 11/1998 | Lee | |
| 7,063,029 | B1 * | 6/2006 | Tsui et al. | 112/475.06 |
| 2003/0005952 | A1 * | 1/2003 | Chen | 135/33.2 |

* cited by examiner

*Primary Examiner*—Jermie E. Cozart
(74) *Attorney, Agent, or Firm*—Malloy & Malloy, P.A.

(57) ABSTRACT

A method of forming an umbrella canopy having a substantially continuously aligned decorative pattern displayed thereon, wherein the canopy is of the type used on large, outdoor and/or recreational umbrellas. The method includes forming an elongated sheet of canopy material with the decorative pattern displayed along a continuous portion of the length thereof. The decorative pattern is defined by a plurality of substantially equivalent, successively disposed pattern segments, wherein adjacent ones of such pattern segments are inverted relative to one another. The canopy sections used to construct the final product of the umbrella canopy are formed by extending each of a plurality of bias cuts along the entire width of the sheet of canopy material and at predetermined angular orientations to a central longitudinal axis of the sheet. The separated canopy sections are then arranged into a substantially common orientation and interconnected to collectively correspond to an intended configuration of the umbrella canopy being formed.

20 Claims, 5 Drawing Sheets

METHOD OF FORMING AN UMBRELLA CANOPY

The present application is based on and a claim to priority is made under 35 U.S.C. Section 119(e) to provisional patent application currently pending in the U.S. Patent and Trademark Office having Ser. No. 60/533,196 and a filing date of Dec. 30, 2003.

BACKGROUND OF THE INVENTION

1. Field of the Invention

The present invention relates to a method of forming the canopy of an umbrella, such as but not limited to large outdoor/recreational umbrellas, so as to display a selected pattern on the canopy. The method of this invention allows for a variety of pleasing and/or intricate patterns to be created on fabric and then displayed in alignment, despite there being a plurality of fabric pieces used to form the umbrella canopy, such that the resulting canopy has a finished look. Compared to the few known ways of creating an umbrella canopy, the method of the present invention offers significant savings in terms of production and assembly time, and other associated costs.

2. Description of the Related Art

It seems there have traditionally been only a limited number of ways to create the canopy of fabric that makes up an umbrella, and in particular, the fabric which covers the ribs of the umbrella frame that allow it to open and close. Perhaps the most common way of creating the canopy is to take a single large piece of fabric and to form it into a circle or other shape suitable matched to that of the umbrella frame in the open position. Of course, if the umbrella is of the type used at outdoor cafés, pool areas and the like, the canopy may be so large as to require stitching together of two or more pieces of fabric together. This generally does not present any problems when the canopy is made of a single solid color, although when it is desired to make the canopy with a fabric having a pattern, greater effort is required to ensure that the pattern will line up once the fabric pieces have been assembled into the canopy. This may be the primary reason that most outdoor recreational umbrellas are seen to have a canopy of a single color, whether blue, green, red, etc.

Of course, umbrella canopies can and do incorporate fabric having a pattern thereon. For instance, some hand-held umbrellas have a canopy with plaid patterns, stripe patterns, polka dots, etc. Due to their relatively small size, however, and the ability to create their canopies with significantly less fabric, the additional effort required to achieve a pleasing finished appearance is not great. As such, the canopy formation of hand-held umbrellas will not be considered further with regard to this application, as the invention described subsequently herein will primarily be discussed in connection with large, outdoor recreational umbrellas, where much more fabric is needed, including typically several pieces of fabric that must be stitched together.

It is also possible for even these larger umbrellas to have canopies made with fabric having a pattern thereon, although due to the time and extra effort required to assemble such fabric correctly, including the extra fabric needed, they are not common. For instance, if a canopy made of a striped fabric is desired, it will require cutting the fabric into different pieces, arranging those pieces so that the stripes will line up and then assembling them together to keep that sequence in order to offer a finished look to the canopy once it is formed. In this process, more fabric is used and/or wasted to achieve the desired result of pattern alignment, with more time and labor involved as well. This, in turn, leads to a higher cost for such umbrella canopies than that associated with canopies made of a single solid fabric. In short, many would like to see and/or purchase outdoor recreational umbrellas with a wider variety of canopy fabrics and styles, and especially, canopies with interesting patterns thereon, but the costs associated with creating such canopies has traditionally been an obstacle to same.

Accordingly, there is a need in this field of art for a method of forming the canopy of an umbrella especially, but not necessarily exclusively, for large outdoor/recreational umbrellas, so as to have a pattern thereon which saves on the production time and other costs associated therewith. Any such method should involve the steps of cutting the fabric that will be used to make the canopy into different pieces, arranging those pieces so that the desired pattern will line up in the shape called for by the canopy, and then assembling them together in a manner which both offers the resulting canopy with a pattern having a finished look and with an ability to withstand the sometimes harsh outdoor elements to which it will be subjected. Any such method would ideally incorporate a planning step for the decorative pattern to repeat in sync despite the use of a plurality of pieces to make up the canopy, and also, the method would ideally be suited for creation of the fabric, including the pattern, by using advanced technology machines that incorporate looms, etc. and which are used in the industry of producing fabric.

SUMMARY OF THE INVENTION

The present invention is directed to a method of producing or forming an umbrella canopy specifically, but not exclusively, of the type used in combination with the larger, outdoor recreational umbrellas found at various public and private locations. More specifically, the method of the present invention is directed to the producing of an umbrella canopy which has a predetermined, substantially continuous decorative pattern on an outer exposed surface thereof. Further, the type of decorative pattern referred to is arranged in a continuously aligned orientation regardless of the size or shape of the umbrella canopy or the intricacies or the decorative details of the pattern itself. Moreover, the method of the present invention facilitates the formation of the decorative pattern on the umbrella canopy in a manner which simplifies the assembly of the pieces or "canopy sections" without the need for detailed, labor intensive, and time-consuming "matching" of the pattern segments in order to accomplish the greatly preferred continuous alignment of the pattern, when displayed on the completed umbrella canopy. In typical fashion, umbrella canopies of the type referred to herein are formed from a plurality of canopy sections each having a portion of the display pattern formed thereon. The assembly of the finished umbrella canopy product is accomplished by joining or attaching the plurality of canopy sections into a collective array which corresponds to or defines the intended size and configuration of the finished canopy.

Therefore, the method of the present invention comprises the forming of an elongated sheet of canopy material having a preselected decorative pattern appearing on at least one exposed surface thereof. The material from which the sheet and canopy are formed may, of course, vary greatly dependent upon the intended application, location, environment and/or use of the umbrella and possibly a variety of other factors. Such materials can include fabric, canvas, flexible synthetic materials including a variety of plastics or plastic coated materials of the type well known in the umbrella industry. The decorative pattern extends continuously along a sufficient length of the sheet to assure the accurate and intended formation of an adequate number of canopy sections. The number size and configuration of the canopy sections are such that, when assembled, they collectively form the umbrella canopy of the intended size and configuration. Therefore, both the length and the width of the sheet may vary dependent upon the intended dimensions and configuration of the final umbrella canopy product.

Formation of the elongated sheet or roll of fabric with the intended decorative pattern appearing thereon further involves defining the decorative pattern by a plurality of pattern segments. Moreover, the pattern segments are successively displayed along a continuous length of the sheet, wherein adjacent ones of the pattern segments are disposed in an inverted orientation relative to one another. As will be explained in greater detail hereinafter, additional preferred embodiments of the method of the present invention also involve the consecutively arranged pattern segments being disposed in a non-coaxial alignment with the central longitudinal axis of the sheet. As such, adjacent ones of the pattern segments are offset or displaced laterally or transversely in opposite directions from the central longitudinal axis of the sheet. Such prearranged orientation and disposition of the plurality of pattern segments, and in particular, adjacent ones of the pattern segments relative to one another facilitates the "automatic" continuous alignment of the various details of the decorative pattern, once the canopy sections are separated from the canopy material sheet and joined into the finished umbrella canopy product.

As indicated above, the method of the present invention also comprises the separating of the canopy material sheet into the requisite number of canopy sections. As such, the canopy sections are formed into predetermined sizes and configurations by means of a plurality of bias cuts extending transversely across the entire width of the sheet. Further, the various bias cuts are disposed at predetermined angular orientations relative to the length or longitudinal axis of the sheet. As such, the bias cuts extend substantially between each of the adjacent pattern segments and therefore define contiguous borders of adjacent pattern segments while accomplishing separation of the sheet into the plurality of canopy sections, as set forth above.

It is emphasized that the bias cuts do not necessarily pass precisely between each of the pattern segments but instead pass through and/or along a path which may interrupt the decorative details of one or both of the correspondingly positioned, adjacent pattern segments. Therefore, adjacently positioned ones of the separated canopy sections may not have a whole or complete pattern segment appearing thereon. However, the precise location of each of the plurality of bias cuts used to form the canopy sections by separating the pattern segments, in the manner set forth herein, facilitates the continuous alignment of the details of the decorative pattern once the canopy sections are joined into the final umbrella canopy product.

As will become more evident from the description of the method of the present invention as hereinafter provided, the decorative details and/or intricacies of the decorative pattern may vary greatly and are not limited to more simplistic patterns or patterns of a specific category such as stripes or other geometric figures. Also, the size, configuration and number of canopy sections required to form the finished umbrella canopy product may also vary greatly depending on the intended size and shape of the finished canopy. Further, the method of the present invention may be used to produce products, other than umbrella canopies, having decorative patterns contained thereon with minimal or no modifications to the various procedures involved.

Accordingly, the present invention overcomes many of the problems and disadvantages associated with the formation of umbrella canopies, as well as a variety of other products, such as but not limited to pillows, etc., which are intended to display any of a wide variety of a decorative patterns by alleviating the necessity to subjectively match sectional components of the product being formed in order to facilitate decorative pattern having continuously aligned details.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several view of the drawings.

DETAILED DESCRIPTION OF THE INVENTION IN THE PREFERRED EMBODIMENT(S)

Figure 1:
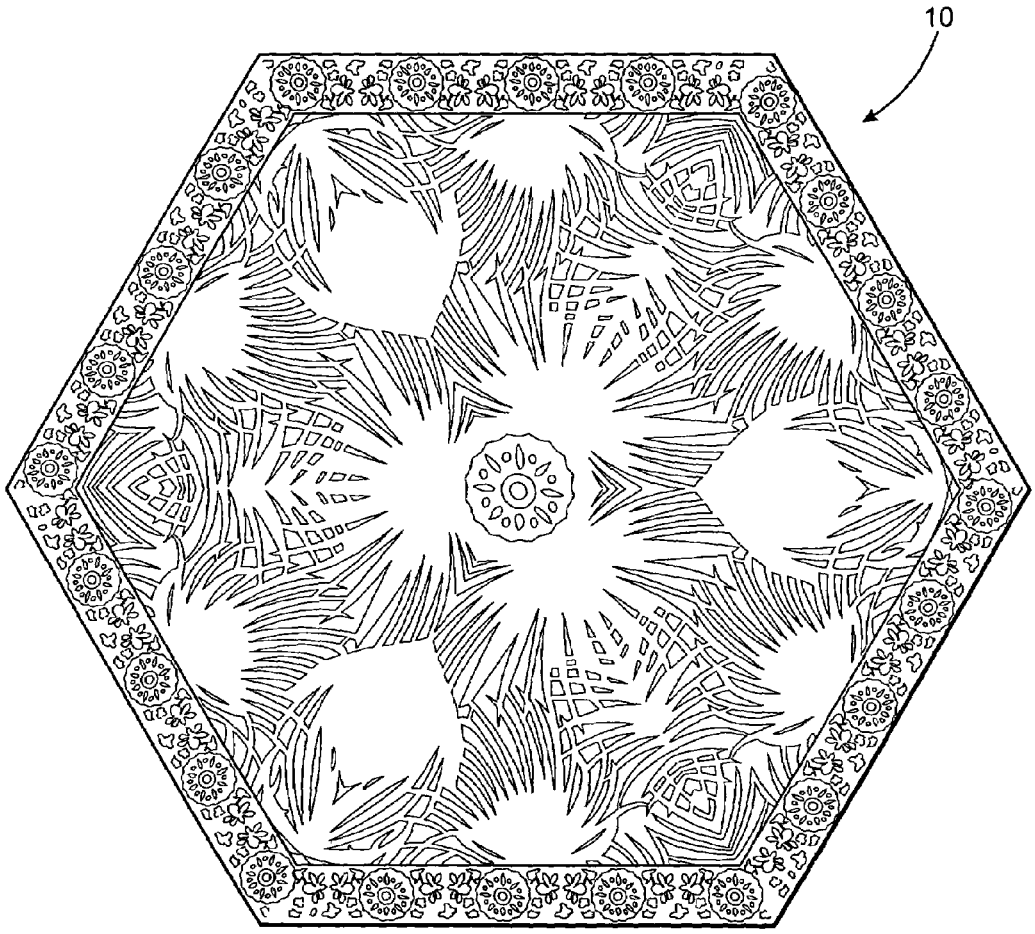
FIG. 1 is a top view of an umbrella canopy demonstrating a decorative pattern with a predetermined, substantially continuous alignment extending along an outer surface thereof.

As shown in the accompanying drawings, the present invention is directed to a method of forming a canopy generally indicated as 10 for an umbrella such as, but not limited to, relatively large outdoor and/or recreational umbrellas. As such, the canopy 10 is typically formed by interconnecting a plurality of canopy sections designated by reference numerals 1 through 6 in FIGS. 2 and 3.

With primary references to FIG. 1, it would be highly desirable to display a decorative yet intricate pattern on at least the outer, exposed surface of an umbrella canopy 10 in order to enhance the overall appearance thereof, as well as add to the surrounding environment in which the umbrella is located. However, in presenting the decorative display on the exterior surface of the canopy 10 it would also be highly desirable to orient the decorative pattern in a manner which presents continuously aligned pattern segments as the pattern "flows" from one canopy section to the next. As set forth previously herein, known or conventional means of accomplishing such continuous alignment of the pattern details has involved extensive cutting and/or matching of various canopy pieces, which in turn has involved the subjective positioning and orienting of such pieces as they are assembled into a final umbrella canopy product. Therefore, the method of the present invention involves the forming or production of an umbrella canopy having a decorative pattern with a predetermined, substantially continuous alignment of successively disposed pattern segments appearing on each of the adjacent canopy sections such as shown by reference numerals 1-6. It is further emphasized that the method of the present invention can be utilized to facilitate continuous alignment of the decorative pattern of the canopy 10 regardless of the simplicity or intricacy of the decorative details which define the displayed pattern.

Figure 4:
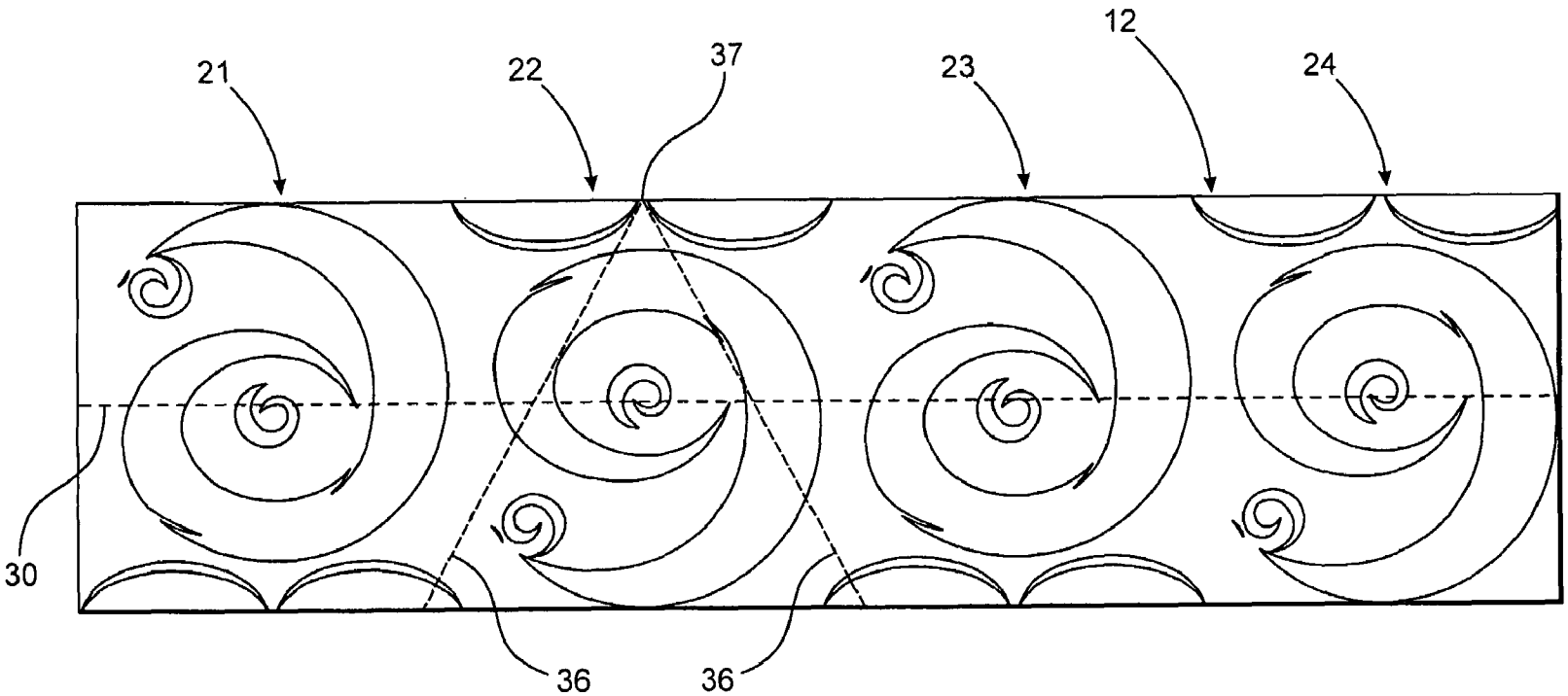
FIG. 4 is a top view in schematic form of a canopy material sheet having a decorative pattern displayed thereon, wherein the decorative pattern is at least partially defined by a plurality of substantially common pattern segments successively arranged along a continuous length of the canopy material sheet.

Moreover, the present invention is directed to a method of forming or producing the umbrella canopy 10 such that the plurality of canopy sections 1-6 are individually formed in a manner which accomplishes "automatic" alignment of the pattern segments and/or decorative details of the pattern, in a continuous manner once the canopy sections 1-6 are assembled in the manner schematically demonstrated in FIG. 1. More specifically, an elongated roll or sheet 12 of fabric material is formed having a predetermined decorative pattern printed or otherwise displayed on at least one surface thereof, as schematically represented in FIG. 4. It is again emphasized that application of the present method is not limited to use with any one pattern. To the contrary, an infinite number of patterns may be utilized with the present invention and may be clearly distinguishable both in appearance and decorative detail as evidenced by a comparison of the decorative patterns of FIG. 4 with that of FIGS. 1 and 5.

Figure 2:
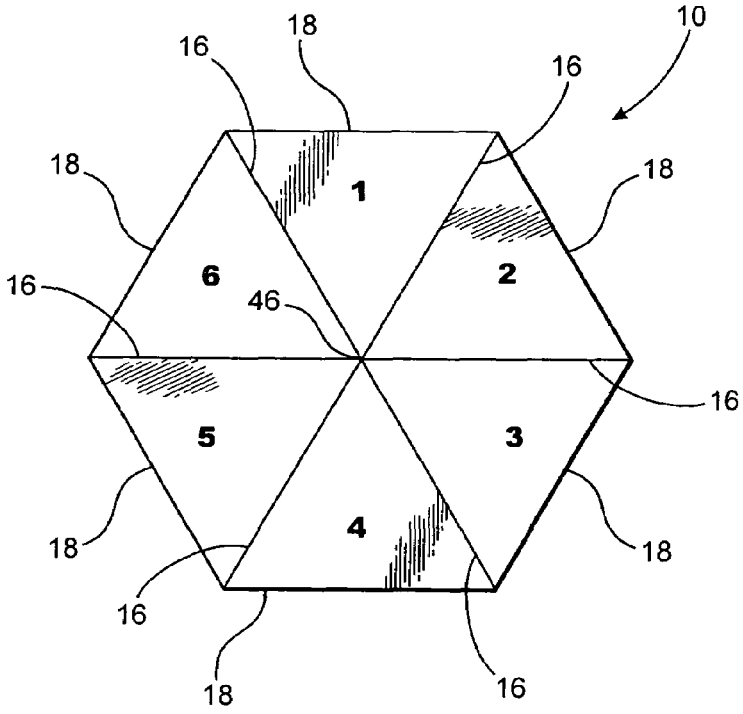
FIG. 2 is a top view in schematic form and partial cutaway of an umbrella canopy having a predetermined configuration and being formed from a plurality of joined canopy sections.

By way of example only, the canopy structure 10 represented in FIG. 1 and schematically disclosed in FIG. 2 comprises a hexagonal configuration. This configuration would ideally correspond to an umbrella frame having (6) ribs and six (6) struts. As such, the sheet of canopy material 12 would be appropriately dimensioned, at least in terms of the width or transverse dimension thereof. The length of the sheet 12 may vary greatly, depending on the number of canopies being formed therefrom, but should be of sufficient longitudinal dimension to at least provide for the formation of the required number of canopy sections for one canopy, as indicated. Further by way of example, the sheet of fabric material 12 may be initially stored as a roll and comprises a width of substantially 54 inches. In this example, the angular peripheral edges as at 16 will have a length of 66 inches, wherein the base 18 of each of the canopy sections will have a length of 62 inches. It is emphasized that the configuration, size and number of the canopy sections 1-6 may vary dependent upon the intended size and configuration of the finished umbrella canopy product. Specifically, the category 10 is not limited to a hexagonal configuration.

Figure 3:
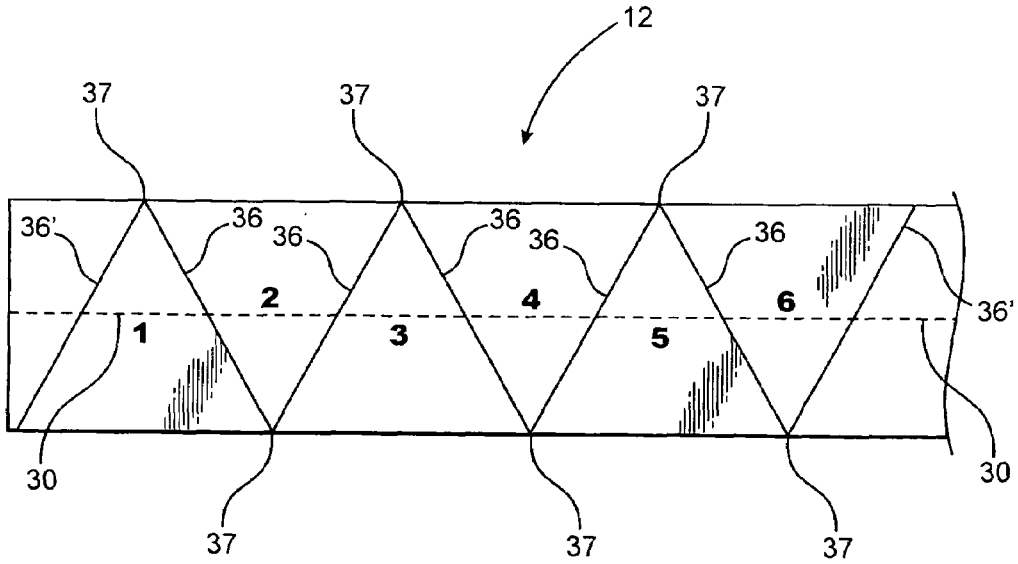
FIG. 3 is a top view in schematic form of an elongated sheet of canopy material wherein the various canopy sections are defined thereon.
Figure 5:
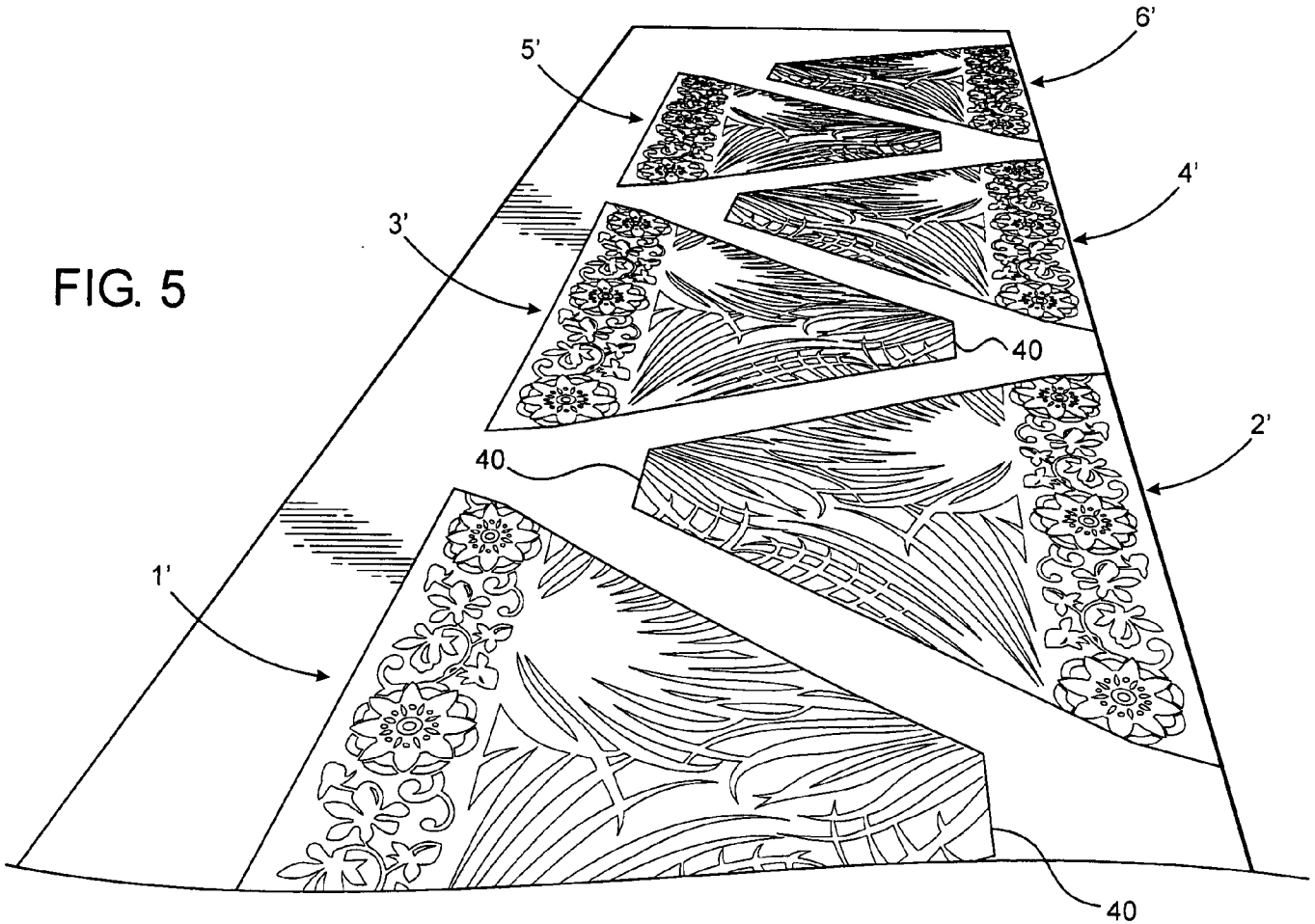
FIG. 5 is a perspective view in partial cutaway representing a plurality of canopy sections separated from one another and from the canopy material sheet of the embodiment of FIGS. 1 and 4.

Referring now to FIGS. 3 and 4, and with the acknowledgment that the decorative pattern appearing in FIG. 4 significantly differs from that appearing in FIGS. 1 and 5, the method of the present invention further comprises defining the displayed, decorative pattern, extending along a continuous length of the sheet 12, as a plurality of successively disposed pattern segments 21, 22, 23, 24, etc. Further, in at least one preferred embodiment of the present invention, each of the adjacent pattern segments 21 through 24 have a reversed or inverted orientation relative to one another, as demonstrated. Therefore, it should be clear that the plurality of pattern segments 21-24, etc. shown in FIG. 4 are each identical in decorative detail and are alternately inverted in their respective orientations. Further, in at least one preferred embodiment each of the plurality of pattern segments 21-24, etc. are disposed in a non-coaxial alignment with the central longitudinal axis of the sheet 12 schematically represented as 30. Moreover, adjacent ones of the plurality of pattern segments 21-24, etc. are offset from the longitudinal axis 30 in opposite directions and at substantially equal distances from the longitudinal axis 30.

The method of the present invention further comprises the formation of each of the plurality of canopy sections 1-6 by separating each canopy section from one another and from the elongated sheet 12 of canopy material. This is accomplished by the extension of a bias cut 36 schematically represented in FIG. 3 at least partially between each of the adjacently positioned pattern segments 21-24, etc. In addition, an equivalent bias cut 36' is also formed at the beginning and end of the first canopy section 1 and the end of the last canopy section 6, as indicated. For purposes of clarity, FIG. 4 also schematically represents two (2) adjacent bias cuts 36. As demonstrated, each of the bias cuts 36 may in fact separate all or portions of adjacent pattern segments 21-24, etc, and in so doing pass through each of the adjacent pattern segments as at 21, 22 and/or 22, 23 demonstrated by the phantom lines 36 in FIG. 4. It is emphasized that in the formation of the individual canopy sections 1-6, the portions of the pattern segments appearing thereon may not be defined by an entire pattern segment. More specifically, each of the canopy sections 1-6 may be formed and dimensioned to have a portion of two adjacent pattern segments appearing thereon. Further, depending on the decorative details of the pattern appearing on the umbrella canopy 10, a complete pattern segment 21-24, etc. may not appear on any one of the canopy sections 1-6.

Figure 6:
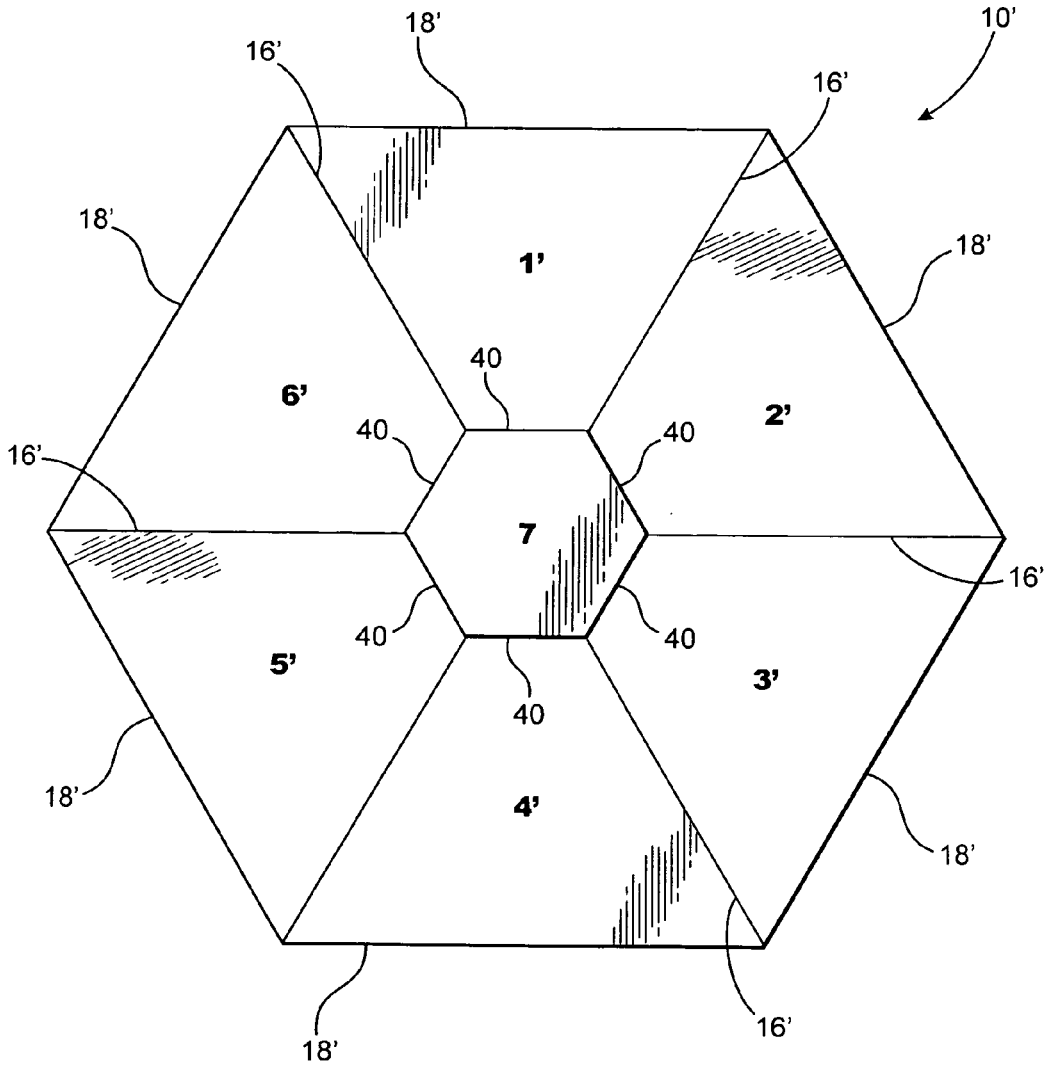
FIG. 6 is a top view in schematic form of yet another preferred embodiment of an umbrella canopy comprising a plurality of canopy sections each of which have a different configuration from the embodiment of FIG. 2.

With reference to FIG. 5 individual canopy sections 1'-6' are represented in separated relation to one another. The structural modification of the canopy sections 1'-6' is represented by a truncated portion 40 of the apex of each of the otherwise triangular configurations of the canopy sections 1'-6'. Hence, the "prime designation" of the structurally modified canopy sections 1'-6'. The truncated apex 40 is formed because of a variance in the canopy configuration appearing in FIG. 6. As such, a center portion 7 may be formed on the canopy 10' to accommodate structural features associated with the umbrella frame or the attachment of the umbrella canopy 10' thereto.

Other features associated with the forming and/or separation of the individual canopy sections 1-6 and/or 1'-6' comprise the extending of each of the bias cuts 36 and/or 36' at a predetermined angle relative to the longitudinal axis 30 of the sheet 12. This angular relationship between the respective bias cuts 36, 36' and the axis 30 is dependent, at least in part, upon the intended size, and possibly the preselected configuration of each of the canopy sections 1-6 and/or 1'-6'. However, in any of the preferred embodiments of the present invention, the respective bias cuts 36 and 36' extend completely along the width and/or transverse dimension of the sheet 12 in order to accomplish complete separation as also clearly demonstrated in FIG. 5.

Also, in at least one preferred embodiment, such as that demonstrated in FIGS. 3 and 4, adjacent ones of the bias cuts 36 begin and end at common points or locations 37 which are coincident to the longitudinal edges of the sheet 12. As a result, and in the embodiment where the preferred shape of the umbrella canopy 10 demonstrated in FIGS. 1, 2, and 6, each of the bias cuts 36 and/or 36' are equal in length and alternate ones of the bias cuts 36 and 36' are disposed in parallel relation to one another.

Once separated in the manner set forth above, the canopy sections 1-6 or 1'-6' are arranged in a substantially common orientation so as to collectively correspond to or conform with the intended configuration of the finished umbrella canopy product 10 or 10'. With reference to FIG. 2, each of the canopies 1-6 have a somewhat common orientation to the extent that apex or convergent end of each of the canopy structures extend towards the center 46 of the canopy 10, wherein the base portions 18 define the outer periphery of the canopy 10. Similarly, in the embodiment of FIG. 6, the truncated ends 40 surround and/or define the outer periphery of a center section 7, wherein the base portions 18' define the outer periphery of the umbrella canopy 10'. Once disposed in the common orientation of FIGS. 2 and 6, each of the canopy sections 1-6 and 1'-6' are joined along adjacently disposed correspondingly positioned peripheral portions or edges 16 and 16' respectively. Once so joined, the decorative details of adjacent pattern segments which appear on adjacent ones of each of the plurality of canopy sections 1-6 and/or 1'-6' will be "automatically" disposed in an aligned relationship. A continuously aligned decorative pattern appearing over the outer or exposed surface of the canopy 10, as clearly demonstrated in FIG. 1, will be displayed. Any matching, excess cutting, subjective alignment, etc. prevalent in the formation of umbrella canopies using prior art or conventional techniques is thereby eliminated.

What is claimed is:

1. A method of producing an umbrella canopy having a predetermined, substantially continuously aligned decorative pattern displayed thereon, said method comprising:

forming an elongated sheet of canopy material with the decorative pattern appearing thereon, defining the decorative pattern by a plurality of pattern segments successively displayed along a continuous length of the sheet, forming adjacent ones of the plurality of pattern segments on the sheet in an inverted orientation, forming a plurality of separated canopy sections by extending a plurality of bias cuts at a predetermined angular orientation to the length of the sheet and at least partially between adjacent pattern segments, arranging the plurality of canopy sections so as to collectively conform to an intended configuration of the umbrella canopy, and joining adjacent, correspondingly disposed portions of adjacent ones of the canopy sections.

2. A method as recited in claim 1 comprising forming one of the bias cuts between two adjacent pattern segments in a contiguous relation to both the adjacent pattern segments.

3. A method as recited in claim 1 comprising extending each bias cut along substantially the entire transverse dimension of the sheet.

4. A method as recited in claim 3 comprising forming each bias cut to have a substantially equal length.

5. A method as recited in claim 3 comprising orienting adjacent bias cuts to define a substantially triangular configuration of each of the plurality of canopy sections when separated.

6. A method as recited in claim 5 comprising further defining the triangular configuration of each of the plurality of canopy sections by a correspondingly disposed peripheral edge of the sheet.

7. A method as recited in claim 5 comprising positioning an end of adjacent ones of the bias cuts at a substantially common location.

8. A method as recited in claim 7 comprising disposing each common location coincident with a longitudinal edge of the sheet.

9. A method as recited in claim 3 comprising forming alternate ones of the bias cuts in parallel relation to one another.

10. A method as recited in claim 1 further comprising forming adjacent ones of the plurality of pattern segments on the sheet in non-coaxial relation to the central longitudinal axis of the sheet.

11. A method as recited in claim 10 comprising forming adjacent ones of the plurality of pattern segments in transversely offset positions relative to the central longitudinal axis of the sheet.

12. A method as recited in claim 11 comprising forming adjacent ones of the plurality of pattern segments in substantially opposite, transversely offset relation to the central longitudinal axis of the sheet.

13. A method as recited in claim 12 comprising forming adjacent ones of the plurality of pattern segments in substantially opposite, equally offset positions relative to the central longitudinal axis of the sheet.

14. A method of forming an umbrella canopy having a substantially continuously aligned decorative pattern displayed thereon, the method comprising:

forming an elongated sheet of canopy material with the decorative pattern displayed along a continuous portion of the length thereof;

at least partially defining the decorative pattern by a plurality of substantially equivalent, successively disposed pattern segments, forming adjacent ones of the plurality of pattern segments on the sheet is an inverted orientation, forming a plurality of separated canopy sections by extending a bias cut at least partially between adjacent ones of the plurality of pattern segments, extending the bias cut substantially along the entire width of the sheet and at a predetermined angular orientation to a central longitudinal axis of the sheet, arranging the plurality of canopy sections into a substantially common orientation to collectively correspond to an intended configuration of the umbrella canopy, and joining adjacent correspondingly disposed peripheral portions of the canopy sections.

15. A method as recited in claim 14 comprising determining the preselected angular orientation at each bias cut based on the intended size of a corresponding one of the canopy sections.

16. A method as recited in claim 15 comprising positioning an end of adjacent ones of the bias cuts at a substantially common location, defining the common location coincident with a longitudinal edge of the sheet.

17. A method as recited in claim 14 comprising orienting adjacent bias cuts to define a substantially triangular configuration of the plurality of canopy sections when separated.

18. A method as recited in claim 17 comprising further defining the triangular configuration of each of the plurality of canopy sections by a correspondingly disposed peripheral edge of the sheet.

19. A method as recited in claim 18 comprising positioning an end of adjacent ones of a bias cut at a substantially common location.

20. A method as recited in claim 19 comprising disposing each common location coincident with a longitudinal edge of the sheet.

* * * * *